US005307960A

United States Patent [19]

Fay, Sr.

[11] Patent Number: 5,307,960

[45] Date of Patent: May 3, 1994

[54] SAFETY AEROSOL DISPENSER

[75] Inventor: James P. Fay, Sr., Marlow, N.H.

[73] Assignee: Omega Securitie, Inc., Marlow, N.H.

[21] Appl. No.: 960,918

[22] Filed: Oct. 14, 1992

[51] Int. Cl.[5] ..... B65D 83/14

[52] U.S. Cl. ..... 222/183; 222/402.13

[58] Field of Search ..... 222/402.13, 402.24, 222/402.1, 183, 182, 131, 509, 4, 394

[56] References Cited

U.S. PATENT DOCUMENTS

| | | | |
|---|---|---|---|
| 3,198,399 | 8/1965 | Sagarin | 222/183 |
| 3,272,391 | 9/1966 | Meshberg | 222/509 |
| 3,272,392 | 9/1966 | Meshberg | 222/183 |
| 3,347,423 | 10/1967 | Bahn et al. | 222/402.13 |
| 3,589,570 | 6/1971 | Gach | 222/402.13 |
| 3,698,604 | 10/1972 | Nigro | 222/402.13 |
| 3,876,113 | 4/1975 | Trotta | 222/402.13 |
| 3,934,761 | 1/1976 | Gentreau | 222/183 |
| 3,958,726 | 5/1976 | Trotta | 222/402.13 |
| 4,044,922 | 8/1977 | Bordelon | 222/183 |
| 4,053,090 | 10/1977 | Kelly | 222/402.13 |
| 4,103,806 | 8/1978 | White | 222/82 |
| 4,220,263 | 9/1980 | Caruso | 222/183 |
| 4,416,399 | 11/1983 | Parr et al. | 222/402.13 |
| 4,572,410 | 2/1986 | Brunet | 222/402.1 |

*Primary Examiner*—Andres Kashnikow
*Assistant Examiner*—Philippe Derakshani
*Attorney, Agent, or Firm*—Davis, Bujold & Streck

[57] ABSTRACT

A safety dispenser suitable for dispensing a jet of material the active ingredient of which can incapacitate an attacker, having a rugged unitary housing defining a trigger finger access opening and an opening through which said jet may issue, a container for housing the material under pressure, being captively housed within the housing and being closed by a manually operable valve spring biased into a closed position, a valve cap attached to the valve and carrying a nozzle for emission of a jet of the material upon operation of the valve by application of pressure by a trigger finger of a user extending through the finger opening, the orientation of the nozzle being restrained such that a jet when emitted will pass through the jet emitting opening.

10 Claims, 1 Drawing Sheet

SAFETY AEROSOL DISPENSER

FIELD OF THE INVENTION

The present invention relates to a safety aerosol dispenser suitable for use by law enforcement agencies without accidental dispensation of the content of the aerosol (for example, a solution of capsaicin) and by the public for personal protection.

BACKGROUND OF THE INVENTION

There are many designs of pressurized dispenser already on the market for the purpose of providing personal protection and for use by law enforcement agencies, postman, etc. for deterring violent attacks. Most of the designs issue a spray of MACE for the purpose of disabling the attacker. The disabling material used in most of the dispensers is oleo-resin, capsicum which is present in a strength of 5% to 8%. Most of the oleo-resin capsicum material is inactive and consists of oils and coloring matter. The only active ingredient in this material is capsaicin which is normally present in the strength of 0.1% to 1% depending upon the kind of peppers used in its production. Various carriers and solvents are used in the various brands presently on the market with some brands using trichlorethylene (a known carcinogen) while others use kerosene, benzene or other solvents many of which are highly flammable and can be set a fire, for example, by being sprayed while lighting a cigarette.

Prior art dispensers are invariably of thin aluminum such as is used in insect sprays and oven cleaners. Due to their light construction, and the thin aluminum wall, available pressure is quite limited. This, in turn, dictates the use of a "mist" type spray rather than the much more effective "jet". These containers are easily damaged and easily crushed. Some of the brands make no effort to provide a safety mechanism with the result that accidental discharge is very easy to achieve. Many have accidentally fired while being placed in a holster. Safety devices inevitably delay use of the devices. The various brands available on the market which provide some means of reducing the chance of an accidental ejection of the material in the dispenser do so by the provision of a variety of means obstructing ready access to the valve used to release the content of the dispenser, including spring loaded flaps, twisting covers, flaps that have to be lifted and/or pushed aside, etc. All of the devices are "throw aways" designed to be used and discarded.

These known designs of dispenser use various pressurizers including freon and propane, the first of which is ecologically undesirable and the second of which is highly flammable.

The various designs intended to reduce the chance of an accidental discharge of the content of the dispenser fall short of the ideal for a number of reasons. Some of them rely on moving parts, not particularly reliable, some can be overcome by the simple application of force which might occur other than in the emergency situation intended for the use of the dispenser, some are too awkward to use effectively, without substantial practice, when faced with an emergency and the associated usual panic. Some rely on the removal of clips (often small and difficult to access) and some are very specific as to the orientation of the dispenser. The resulting substantial, in the circumstances, loss of time in bringing the dispenser into action when it is needed can be disastrous.

It is an object of the present invention to provide safety dispenser for dispensing a disabling agent which is substantially tamper proof, has no moving parts associated with its security and safety, is robust, reliable and easy to use, and which uses an active material, which provides the dispenser with an unlimited shelf life, and a pressurizer which is inert.

SUMMARY OF THE INVENTION

According to the invention there is provided a safety dispenser suitable for dispensing a jet of material, the active ingredient of which is capable of incapacitating an attacker, comprising a rugged unitary housing defining a trigger finger access opening and an opening through which said jet may issue, a container for housing a said material under pressure, the container being captively housed within the housing and being closed by a manually operable valve which is spring biased into a closed position, a valve cap attached to the valve and carrying a nozzle for emission of a jet of the material, when present, upon operation of the valve by application of pressure by a trigger finger, of a user, extending through the finger opening, the orientation of the nozzle being restrained such that a jet when emitted will pass through the jet emitting opening.

BRIEF DESCRIPTION OF THE INVENTION

The present invention will now be described, by way of example, with reference to the accompanying drawings in which.

DESCRIPTION OF THE PREFERRED EMBODIMENT

Figure 4:
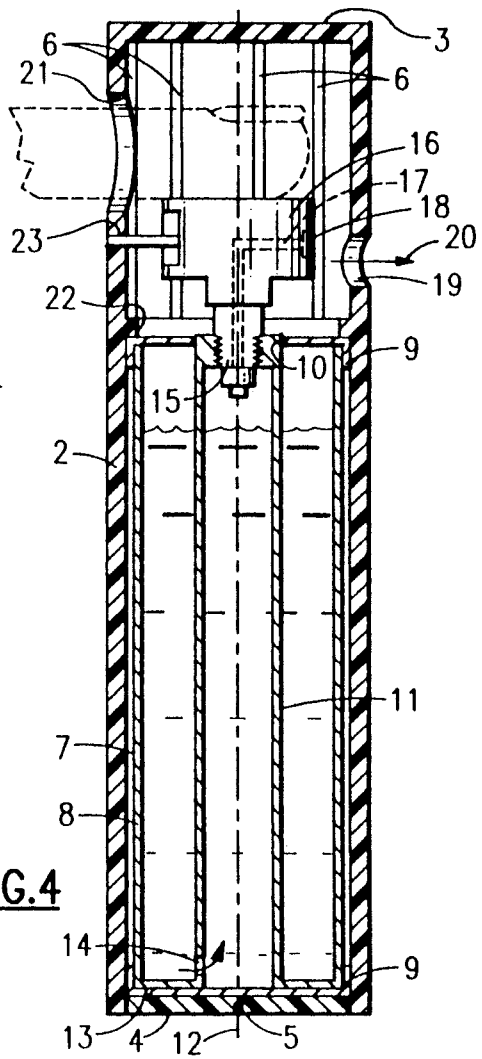
FIG. 4 is a diagrammatic explanatory cross-section of the dispenser illustrated in FIG. 1.
Figure 3:
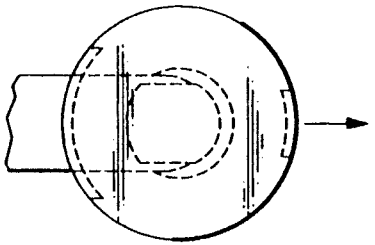
FIG. 3 is a diagrammatic plan view of the dispenser illustrated in FIG. 1.
Figure 2:
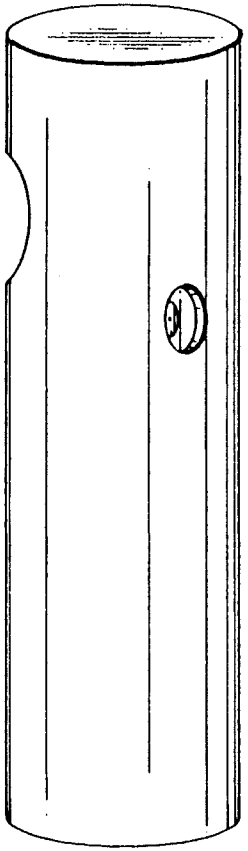
FIG. 2 is a diagrammatic perspective view of the dispenser illustrated in FIG. 1 viewed from substantially the opposite direction to the view shown in FIG. 1.
Figure 1:
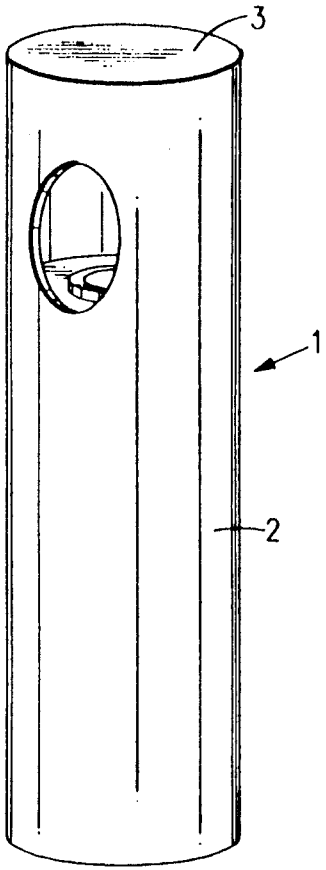
FIG. 1 is a diagrammatic perspective view of a dispenser according to the present invention showing the finger access hole thereof.

The invention will now be described with reference to the drawings. The dispenser 1 has a cylindrical housing 2 closed at both ends and constructed of black, highimpact ABS (acrylonitrile butadiene polymer). The upper end 3 is permanently closed while the lower end 4 is closed by a closure held in place by a pin 5 in an interference fit with a closure 4 and the wall of the housing 2. The lower closure 4 is not removable without special tools and is, therefore, substantially tamper proof so far as the user of the dispenser is concerned. As assembled, the housing 2 constitutes what is in effect a unitary body which is extremely rugged. To this end, the wall thickness of the cylinder walls is approximately ⅛ of an inch and is reinforced on its interior by longitudinally extending ribs 6 spaced about the inner circumference of the housing 2. Test samples of the dispenser in a fully charged condition utilizing this housing have been hurled from a fourth floor window onto a concrete sidewalk without damage and have been placed under the wheels of a 40 foot tractor-trailer full of milk and repeatedly run over also without damage and also without accidental discharge.

The active ingredient of the dispenser is pure capsaicin constituting 5% of a mixture, to be dispensed, which also includes equal parts of water and isopropyl alcohol. The pressurizer is nitrogen. These materials are housed in a copper container 7 comprising a cylindrical side wall 8 closed by two end caps 9 which are soldered to the side wall 8. The upper end cap 9 has a central opening 10 through which a tubular central reservoir 11 extends for the full length of the container 7 along the axis 12 of the dispenser 1. The reservoir 11 is held in position, at the end of the container 7 remote from the opening 10, by a disc 13 held captive between the side wall and the lower end cap of the container 7 and defining a central opening into which extends the lower end of the reservoir 11 for location by the disc. The reservoir 11 is permanently attached in the opening 10 in a manner to produce a seal between the reservoir 11 and the container 7 in this opening 10.

An opening 14 extends through the cylindrical wall of the reservoir 11 adjacent the disc 13 to allow communication of the contained mixture and the pressurizing agent therethrough. The upper end of the reservoir 11 is closed by a spring release valve 15 (e.g. a Dill valve) of well know design which will not be described further here. The valve 15 carries a valve cap 16 which defines a passage 17 (shown in ghost) which connects the outlet passage from the valve 15 with a nozzle 18 in the cap 16 positioned to direct a jet of the capsaicin, water and isopropyl alcohol mixture in a direction normal to the axis 12 through an opening 19 in the cylindrical wall of the housing 2 in the direction of the arrow 20.

When it is desired to operate the dispenser to eject the material therein through the nozzle 18, an operators finger or thumb, usually the forefinger, is inserted through a finger access opening 21 to press the valve cap 16, against the valve 15 closure pressure applied by its valve spring, to open the valve 15 thereby allowing the pressurized nitrogen in the container 7 to drive the capsaicin, water and isopropyl alcohol mixture through the nozzle 18 in the direction of the arrow 20.

The container 7 is captively housed in the housing 2 between the lower end closure 4 and a projection 22 extending inwardly of the periphery of the housing 2. Although illustrated as an annular ring the projection 22 may be replaced by other means such as screws or rivets or pins without departing from the inventive concept here involved.

The cap 16 is maintained in its desired orientation about the axis 12 by means of a pin 23 disposed in an interference fit in the housing 2 and extending into a longitudinal slot in the cap 15 whereby longitudinal movement of the cap 16 is accommodated while rotation about the axis 12 is restrained.

If operation of the dispenser is required when it is in other than the upright position shown, the provision of the reservoir 11 with an opening adjacent the bottom thereof provides an adequate supply of material to be dispensed no matter what the orientation of the dispenser at the time of its operation.

The active ingredient in the dispenser of the present invention is a synthetically produced pure capsaicin which is identical to the natural capsaicin except that, as opposed to being available in an unpredictable strength, it can be purchased at a strength at 100%. The 100% pure capsaicin is diluted to a strength of 5% by volume of the content of the dispenser, the balance of which is water and isopropyl alcohol and therefore provides a solution in which the active ingredient is 5% as opposed to the 0.1% to 1% of the presently available competitive products. The balance of the solution is isopropyl alcohol, which is completely harmless, in a 50—50 mix with water in order to eliminate the possibility of fire. The pressurizer is nitrogen, an inert completely harmless gas. Thus the materials to be dispensed from the dispenser of the present invention are harmless, standard from batch to batch, extremely effective (about 100 times more effective than the materials dispensed in competitive dispensers) and ecologically benign. The dispenser of the present invention is intended for reuse once it is discharged. This is achieved by returning the dispenser to the manufacturer who has the facility to remove the lower end closure 4 so that the container 7 and the valve assembly may be removed, once the pin 23 is also removed, for refilling by way of the valve assembly.

I claim:

1. A safety dispenser suitable for dispensing a jet of material, the active ingredient of which is capable of incapacitating an attacker, comprising:

a rugged unitary housing defining a trigger finger access opening and an opening through which said jet may issue, a container for housing said material for incapacitating an attacker under pressure, the container being captively housed within the housing and being closed by a manually operable valve which is spring biased into a closed position, a valve cap attached to the valve and carrying a nozzle for emission of a jet of the material upon operation of the valve cap by application of pressure by a trigger finger, of a user, extending through the finger opening, the orientation of the nozzle being restrained such that a jet when emitted will pass through the jet emitting opening;

wherein said housing is an elongate housing closed at both ends and defining a longitudinal axis, the container is an elongate container captively held within the housing with the valve structure extending along the axis for operation by a trigger finger extending through the finger opening said finger opening and jet emitting opening defined in a wall of the housing laterally of the axis.

2. A dispenser according to claim 1 wherein said housing is constructed of ABS plastic.

3. A dispenser according to claim 1 wherein said container is constructed of copper.

4. A dispenser according to claim 1 wherein the container is filled with the material in the form of a solution containing capsaicin.

5. A dispenser according to claim 4 wherein the capsaicin is pure capsaicin.

6. A dispenser according to claim 5 wherein the pure capsaicin is synthetic.

7. A dispenser according to claim 4 wherein the solution comprises 5% of pure capsaicin.

8. A dispenser according to claim 7 wherein the balance of the solution comprises isopropyl alcohol and water.

9. A dispenser according to claim 8 wherein the solution is pressurized by nitrogen.

10. A dispenser according to claim 1 wherein said housing has no moving parts.

* * * * *